US007721879B2

(12) United States Patent
Weaver et al.

(10) Patent No.: US 7,721,879 B2
(45) Date of Patent: May 25, 2010

(54) BAR CODE BLOCKING PACKAGE

(75) Inventors: William N. Weaver, Northbrook, IL (US); Joel A. Richardson, Naperville, IL (US); Leslie S. Marco, Bloomingdale, IL (US)

(73) Assignee: Illinois Tool Works Inc., Glenview, IL (US)

( * ) Notice: Subject to any disclaimer, the term of this patent is extended or adjusted under 35 U.S.C. 154(b) by 581 days.

(21) Appl. No.: 11/799,041

(22) Filed: Apr. 30, 2007

(65) Prior Publication Data

US 2007/0295621 A1 Dec. 27, 2007

Related U.S. Application Data

(60) Provisional application No. 60/796,721, filed on May 2, 2006.

(51) Int. Cl.
*B65D 85/00* (2006.01)

(52) U.S. Cl. ..... 206/150; 206/459.5

(58) Field of Classification Search ..... 206/145, 206/150, 151, 484, 484.2, 459.5, 427, 432; 235/487, 484, 491, 494

See application file for complete search history.

(56) References Cited

U.S. PATENT DOCUMENTS 3,513,970 A * 5/1970 Eckholm, Jr. ..... 206/150
3,541,751 A 11/1970 Quebe et al.
4,207,221 A 6/1980 Tobias et al.
4,431,693 A 2/1984 Skukowski
4,827,114 A 5/1989 Blachon
4,941,573 A * 7/1990 Fuerstman ..... 206/459.5
5,074,399 A 12/1991 Kettle et al.
5,492,222 A 2/1996 Weaver
5,502,304 A 3/1996 Berson et al.
5,544,749 A * 8/1996 Watts ..... 206/459.5
5,667,071 A 9/1997 Nakagoshi et al.
5,682,983 A 11/1997 Weaver et al.

(Continued)

FOREIGN PATENT DOCUMENTS

EP 0 677 453 A1 10/1995
EP 0 812 780 12/1997
GB 2 225 566 6/1990
WO WO 96/11140 4/1996

OTHER PUBLICATIONS

Co-pending U.S. Appl. No. 11/799,054, filed Apr. 30, 2007, entitled "Bar Code Blocking System".
Co-pending U.S. Appl. No. 12/053,296, filed Mar. 21, 2008, entitled "Bar Code Blocking Package".
Co-pending U.S. Appl. No. 12/053,363, filed Mar. 21, 2008, entitled "Single Color Bar Code Printing On A Multi-Package".
Co-pending U.S. Appl. No. 11/799,040, filed Apr. 30, 2007, entitled "Bar Code Blocking Package".

*Primary Examiner*—Luan K Bui
(74) *Attorney, Agent, or Firm*—Pauley Petersen & Erickson

(57) ABSTRACT

A method and apparatus for blocking a bar code in a package includes a carrier with a plurality of apertures. The carrier is formed with a plastic material containing an absorbing dye and a fluorescing dye so that a bar code on each container is not readable by a bar code scanner.

14 Claims, 5 Drawing Sheets

U.S. PATENT DOCUMENTS 5,919,028 A 7/1999 Edqvist
6,050,399 A * 4/2000 Pratt ..... 206/158
6,234,945 B1 5/2001 Weaver
6,484,478 B1 11/2002 Arends et al.
6,598,738 B2 7/2003 Weaver
6,688,465 B2 2/2004 Arends et al.
6,868,652 B2 3/2005 Arends et al.
6,880,313 B1 4/2005 Gessford et al.

* cited by examiner

BAR CODE BLOCKING PACKAGE

CROSS REFERENCE TO RELATED APPLICATION

This application claims the benefit of U.S. Provisional Application No. 60/796,721 filed on 2 May 2006.

BACKGROUND OF THE INVENTION

1. Field of the Invention

This invention relates to a package of containers that facilitates proper bar code scanning.

2. Description of Prior Art

Conventional container carriers are often used to unitize a plurality of similarly sized containers, such as cans, bottles, jars and boxes and/or similar containers. Flexible plastic ring carriers are one such conventional container carrier.

Such flexible plastic ring carriers for cans and bottles may or may not have labels printed on the carrier. Often it is desirable to add a Universal Product Code (UPC) or "bar code" (the terms "UPC" and "bar code" are used interchangeably herein) to the container to identify individual containers and the carrier to identify the multi-container package, or multi-package. Containers within the multi-package that are individually coded with the bar code enable a bar code scanner or reader (also used interchangeably herein) to read product information, such as price.

Flexible plastic ring carriers may be used to unitize groups of four, six, eight, twelve or other suitable groups of containers into a convenient multi-package. In such cases, it is preferable to block any bar code on the individual container. This will prevent the bar code for individual containers from being read in place of or in addition to the bar code for the multi-pack. When such containers are placed within a multi-package such as a "six pack," difficulties may arise when container bar codes with individual container information are scanned instead of package bar codes with the information relevant to the multi-package or six pack.

Traditional multi-packages, such as six-packs, include containers that are positioned in random rotational orientations within the carrier. Each container generally includes an individual bar code which includes information, such as price, regarding the individual container. However, when the bar code for the individual container is scanned as the multi-package price, problems may arise for the vendor. Such problems primarily include a single container price being charged for a multi-container package and the inventory control problems that may result.

As such, it is desirable to ensure that the correct bar code is scanned for the correct container and/or multi-package. More specifically, it may be desirable to block the bar codes of individual containers within a multi-package from the scanning process.

SUMMARY OF THE INVENTION

The present invention is directed to a package that includes a flexible carrier and a plurality of containers.

According to a preferred embodiment of this invention, a plurality of containers, such as cans, are positioned within a carrier manufactured with specifically selected blended dyes to both absorb laser light from the bar code reader and to replace that light absorbed to maintain the neutral color of the carrier. As a result, a bar code reader is less likely to read the bar code on each container.

The carrier of the present invention, although traditionally generally transparent, may additionally include an absorbing dye and a fluorescing dye. The area of the carrier that includes such dyes preferably extends across an entirety of the carrier however it may alternatively extend through a center of the carrier or across or along any other suitable area of the carrier.

Accordingly, the plurality of containers are positioned in the carrier so that each bar code is blocked by either the carrier and/or the containers are oriented in a rotationally inward position toward a center of the package and preferably toward an area of the carrier that includes the absorbing dye and the fluorescing dye. Alternatively, containers may be rotationally oriented in the carrier in any other suitable manner such that a bar code scanner is less likely to read individual bar codes on the respective containers. The area of the carrier that includes the absorbing dye and the fluorescing dye preferably prevents any light from the bar code scanner from contacting and reading the bar codes of the individual containers.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
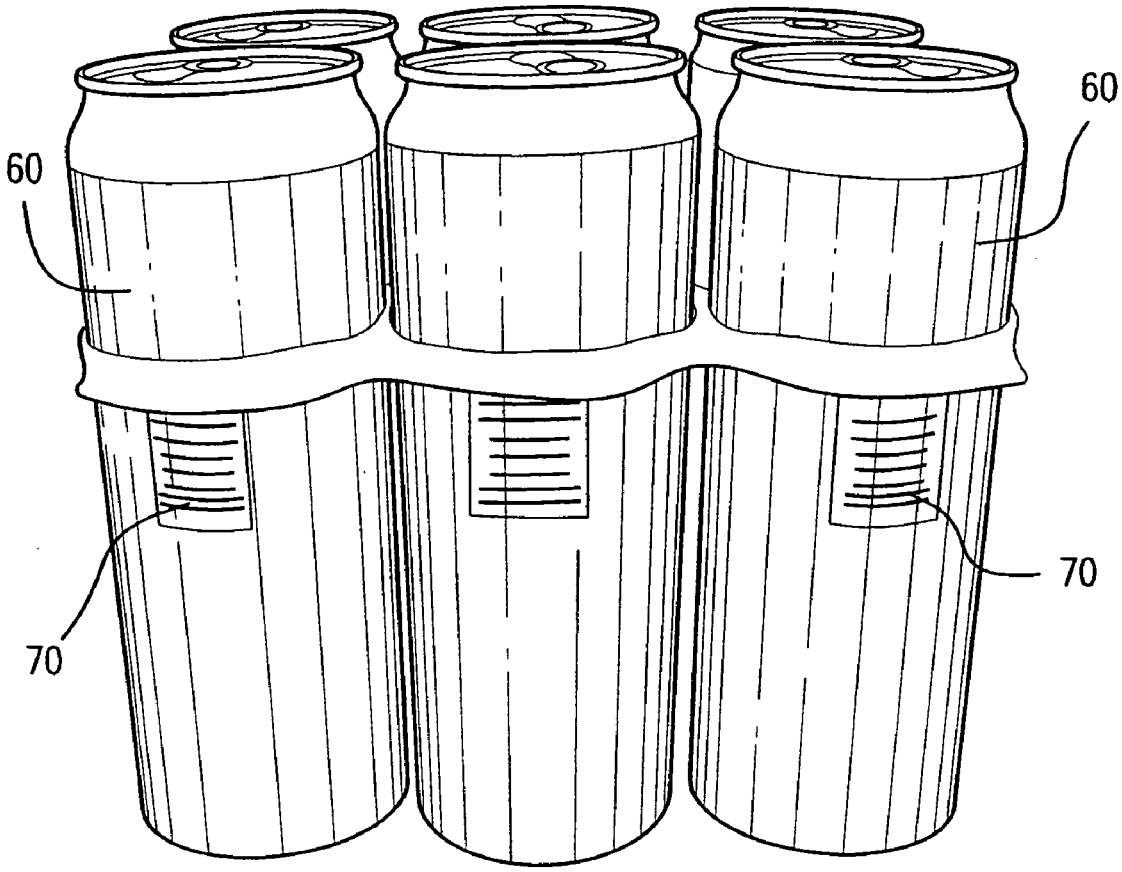
FIG. 1 PRIOR ART
FIG. 1 is a side view of a multi-package of containers assembled in a conventional manner with individual bar codes in random rotational orientations.

FIG. 1 shows a multi-package of six containers 60 unitized in a carrier to form a multi-packaging device. As shown, an exterior face of each container 60 includes a machine readable universal product code ("UPC"), referred to herein as bar code 70, printed thereon. Bar code 70 on each individual container 60 permits container 60 to be scanned by a bar code reader or scanner. When bar code 70 on container 60 is scanned by the bar code reader, information, such as the price, about the individual container 60 is retrieved from a computer connected with respect to the bar code reader. According to a preferred embodiment of this invention, the lines on bar code 70 are aligned in a generally horizontal orientation relative to container 60.

As shown in FIG. 1, a package of individual containers 60 comprises a unitized group of containers 20 sold as a multi-package. The unitized containers 60 are generally randomly oriented so that each container 60 is positioned in a different and/or random rotational orientation within the carrier. The package may have a separate bar code (not shown in FIG. 1) which allows information about the package, such as the price of the group of containers 60, to be retrieved when the separate bar code is scanned by the bar code reader. This separate "package" bar code may be printed on the exterior of the package or otherwise affixed to the package by suitable means, such as adhesive.

Figure 2:
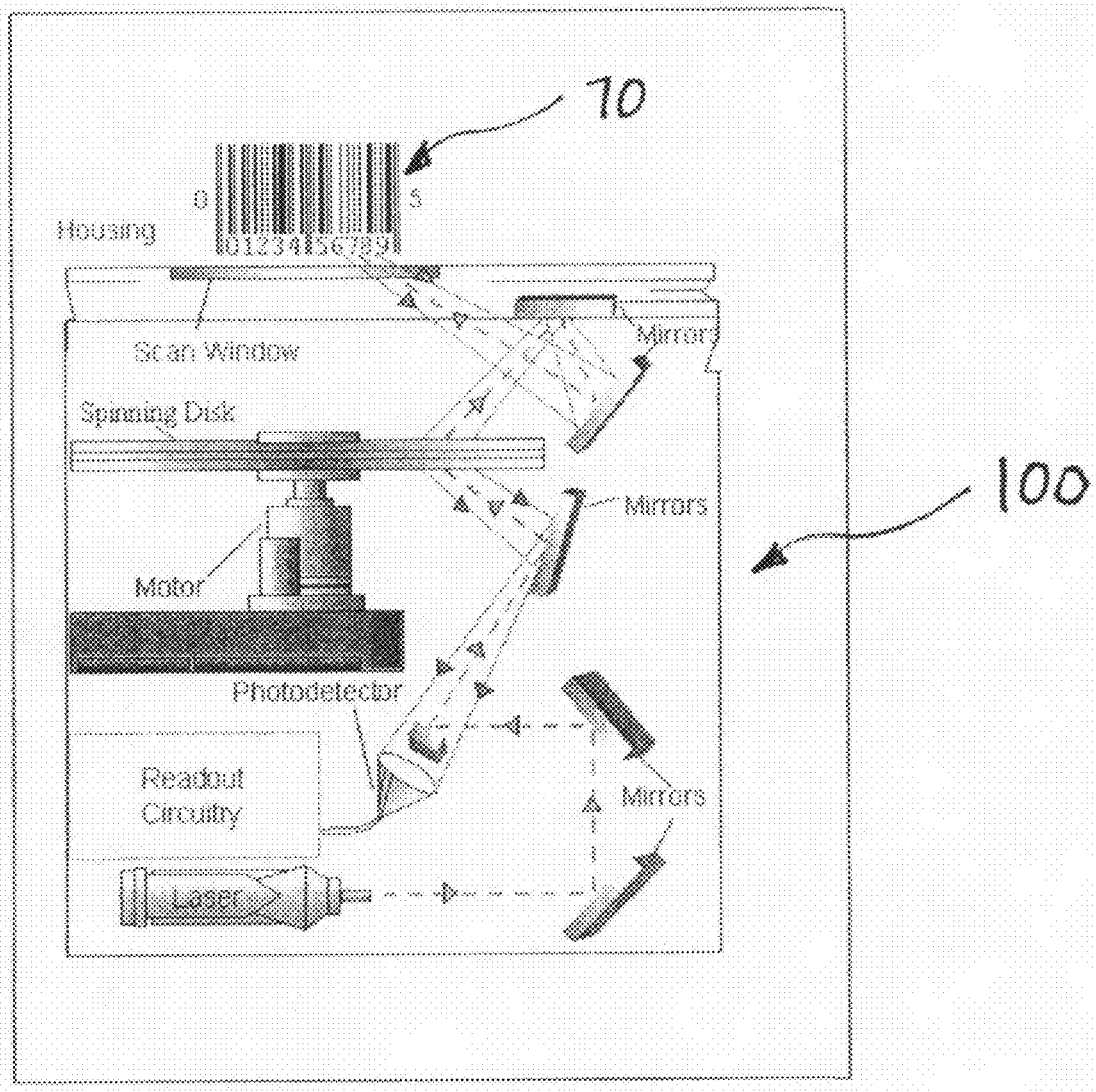
FIG. 2 PRIOR ART
FIG. 2 is a schematic view of a typical bar code reader.

FIG. 2 shows a schematic of a conventional bar code scanner or reader 100. Bar code reader 100 traditionally uses laser light beams that are scanned across bar code 70 optically. In order to accept the broadest range of configurations, bar code readers 100 have been reported in the literature from wavelengths as low as 630 nm to 940 nm. Many point of sale bar code readers 100 fall in the range of 650 to 670 nm. The configuration of a typical point of sale bar code reader 100 is shown in FIG. 2. The laser beam is scanned across bar code 70 by moving the disk and/or the mirrors.

However, problems and mis-scans may arise if the bar code reader 100 instead scans bar code 70 of the individual containers 60 in lieu of the separate package bar code. Such mis-scans may result in a single container 60 price being charged for a multi-container package.

Figure 4:
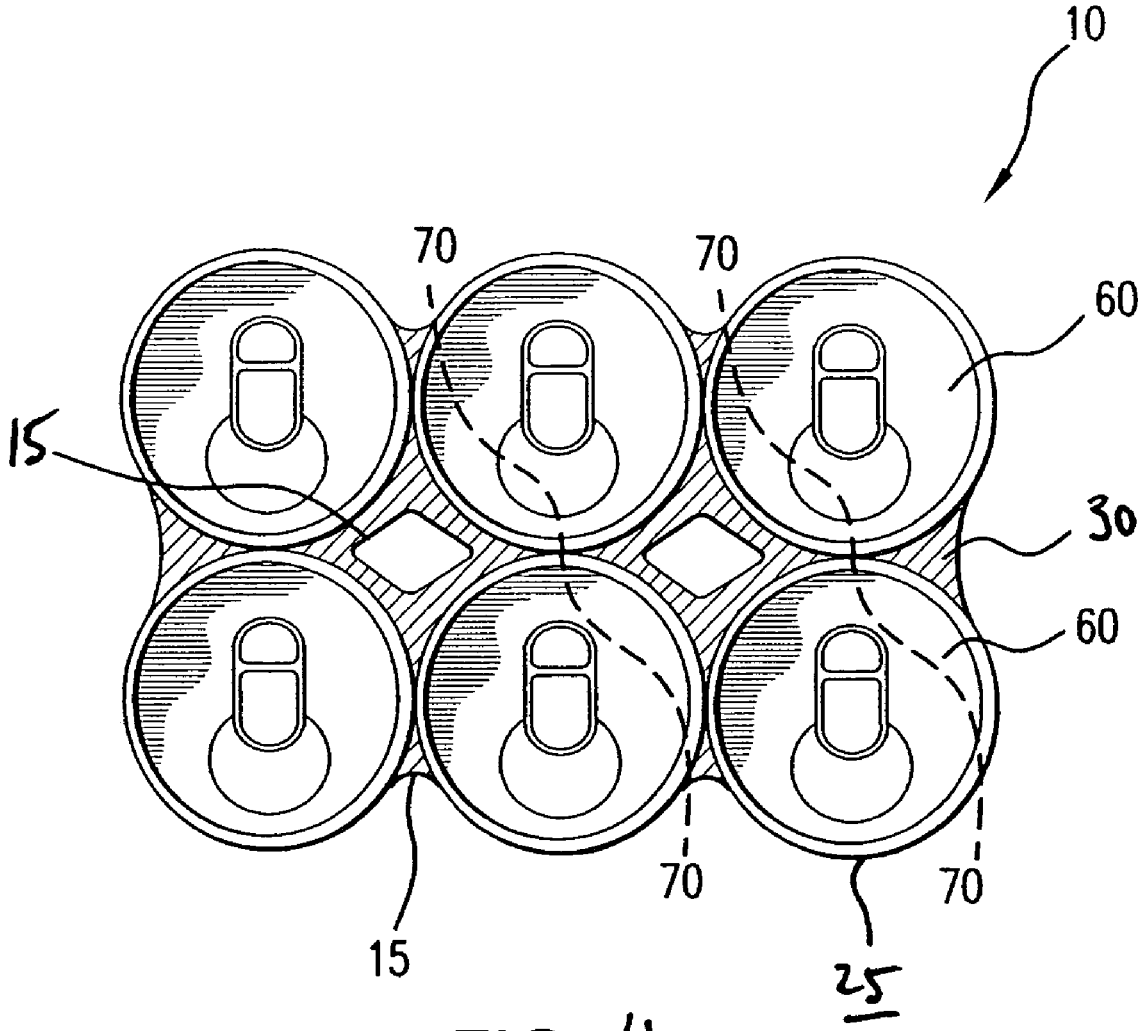
FIG. 4 is a top schematic view of a multi-package similar to a package according to one preferred embodiment of this invention.

FIG. 4 shows a top view of a multi-package 10 according to a preferred embodiment of this invention. As shown, multi-package 10 may include a plurality of containers 60, such as cans. Although FIG. 4 shows one preferred embodiment of this invention wherein each bar code 70 has been oriented into a preferably inward position relative to multi-package 10, an alternative embodiment of this invention includes carrier 15 applied in a suitable position over at least a portion of each respective bar code 70 such that specific orientation is not required. Although cans are shown in FIG. 4, bottles or any other commonly unitized container may be used in multi-package 10 according to this invention. Containers 60 are preferably, though not necessarily, like-sized within a single flexible carrier 10.

Each carrier 15 preferably includes sheet 20 having a width and length defining therein a plurality of container receiving apertures 25, each for receiving a single container 60. The plurality of container receiving apertures 25 are preferably arranged in longitudinal rows and longitudinal ranks so as to form an array of container receiving apertures 25, such as two rows by three ranks for a six container multi-package, two rows by six ranks for a twelve container multi-package, etc. Container receiving apertures 25 are preferably elongated in a longitudinal direction of carrier 10.

Sheet 20 and thus carrier 15 of the present invention are preferably substantially transparent and made of a suitable plastic material, preferably, generally transparent and preferably formed in extruded sheets, such as low to medium density polyethylene. In addition, according to a preferred embodiment of this invention, a light absorbing dye and a fluorescing dye are included in sheet 20, either as an additive during the forming process, such as during extrusion, or post process, such as with inks, tapes or similar post process applications.

According to a preferred embodiment of this invention, red dyes are identified and used that absorb the light at about 670 nm. Although traditionally referenced as an infrared absorber, such dyes are in fact visible light in the red region. Although various dyes absorb a significant amount of light in the proper wave band, such dyes do not consistently prevent a read of bar code 70. Additionally, the removal of red light from the generally transparent plastic material resulted in a definite blue cast to resulting carriers 15.

The color shift to blue is generally undesirable since bottlers, retailers and consumers generally prefer a neutral colored and/or generally transparent carrier 15. Color correction through additional dyes to absorb blue light is generally undesirable as this solution could potentially have resulted in a grey carrier, neutral in color but with an overall attenuation in light transmission. Issues with the color shift, supply of the dyes, and the effectiveness of the UPC blocking effect all contributed to a requirement for an alternative solution.

Figure 3:
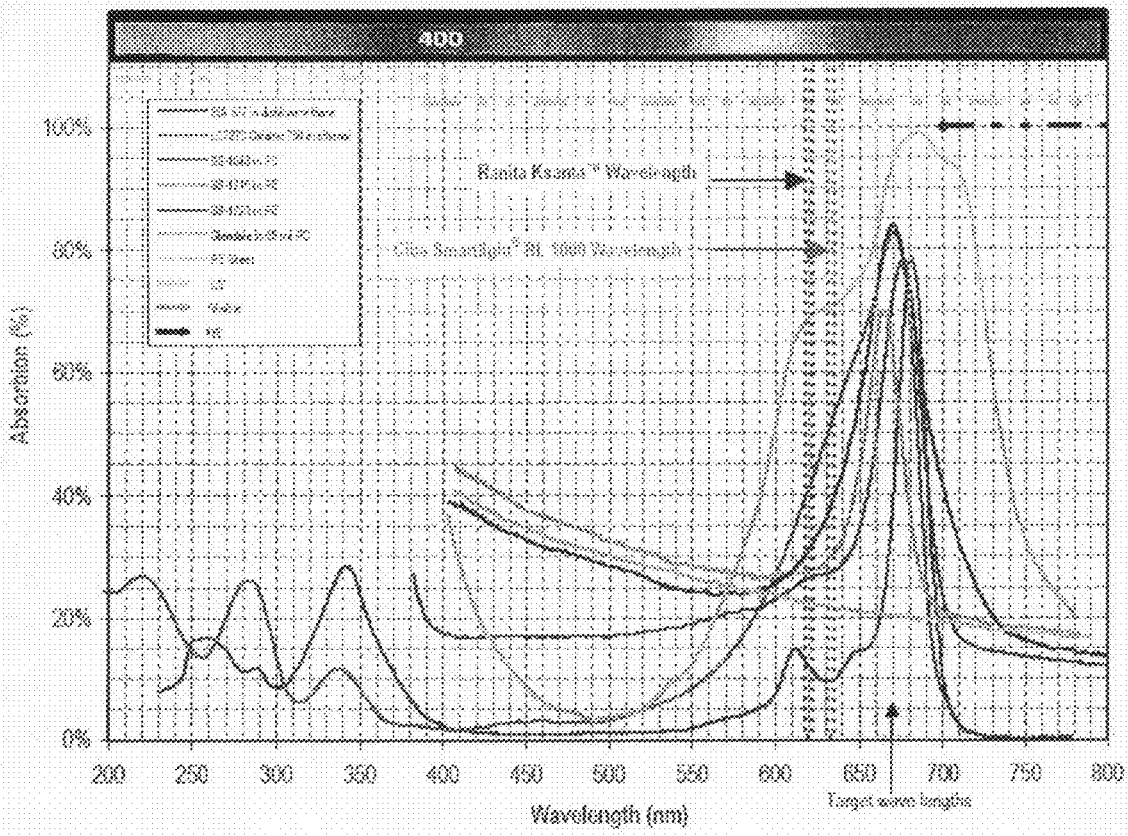
FIG. 3 is a graph showing absorption curves of various red absorbing dyes and fluorescence frequencies of two UV fluorescing dyes for use with preferred embodiments of this invention.

According to a preferred embodiment of this invention, the fluorescing dye comprises specifically a UV fluorescing dye or similar additives that absorb light in the UV region of the spectra and fluoresce in the red visible region of the spectra are desirable for use in connection with sheet 20. Examples of desirable additives include Ranita Ksanta™ which fluoresces at 600 to 630 nm, and Smartlight® RL 1000 by Ciba Specialty Chemicals which fluoresces at 630 to 640 nm. These materials may yield red hued polyethylene films or sheet 20. FIG. 3 shows absorption curves for various red absorbing dyes tested, the target range to be blocked and the fluorescence frequencies of two UV fluorescing dyes.

By coupling the two dyes, the red absorbing dyes in the range of 660 to 680 nm and the UV fluorescing dyes that translate light in UV wavelengths to the range of 600-640 nm, carrier 15 includes both enhanced blocking effect of the red absorbing dye through added red in the film, and enhanced blocking of color shift from the red absorbing dyes. By compensating for the loss in red by translating UV to the red wavelengths, the "graying" effect of the blue absorbers is minimized in carrier 15 while countering the blue shift by adding red instead of subtracting blue. This combination preferably blocks UPC scans of bar code 70 on individual containers 70 and/or multi-packages 10 while maintaining a neutral color. Additional additives may be included within carrier 15 including a third dye to fine tune a resulting color balance in carrier 15, for instance, to minimize "graying" of carrier 15 and/or enhance translucence of carrier 15.

As shown in FIG. 4, carrier 15 preferably includes sheet 20 having an absorbing dye and a fluorescing dye, such as a UV fluorescing dye, comprising an entire area 30 of sheet 20. This preferred embodiment of the invention preferably results from the absorbing dye, preferably the red absorbing dye and the fluorescing dye being added during the manufacturing process of sheet 20 and/or carrier 15. Such process preferably includes mixing pelletized plastic with the suitable dye additives before or during the extrusion process, extruding suitable sheet material and then punching such sheet material to form carriers 15. More preferably, the red absorbing dye and the fluorescing dye are mixed with plastic material to form a combined particle that is then suitable for extrusion.

Figure 5:
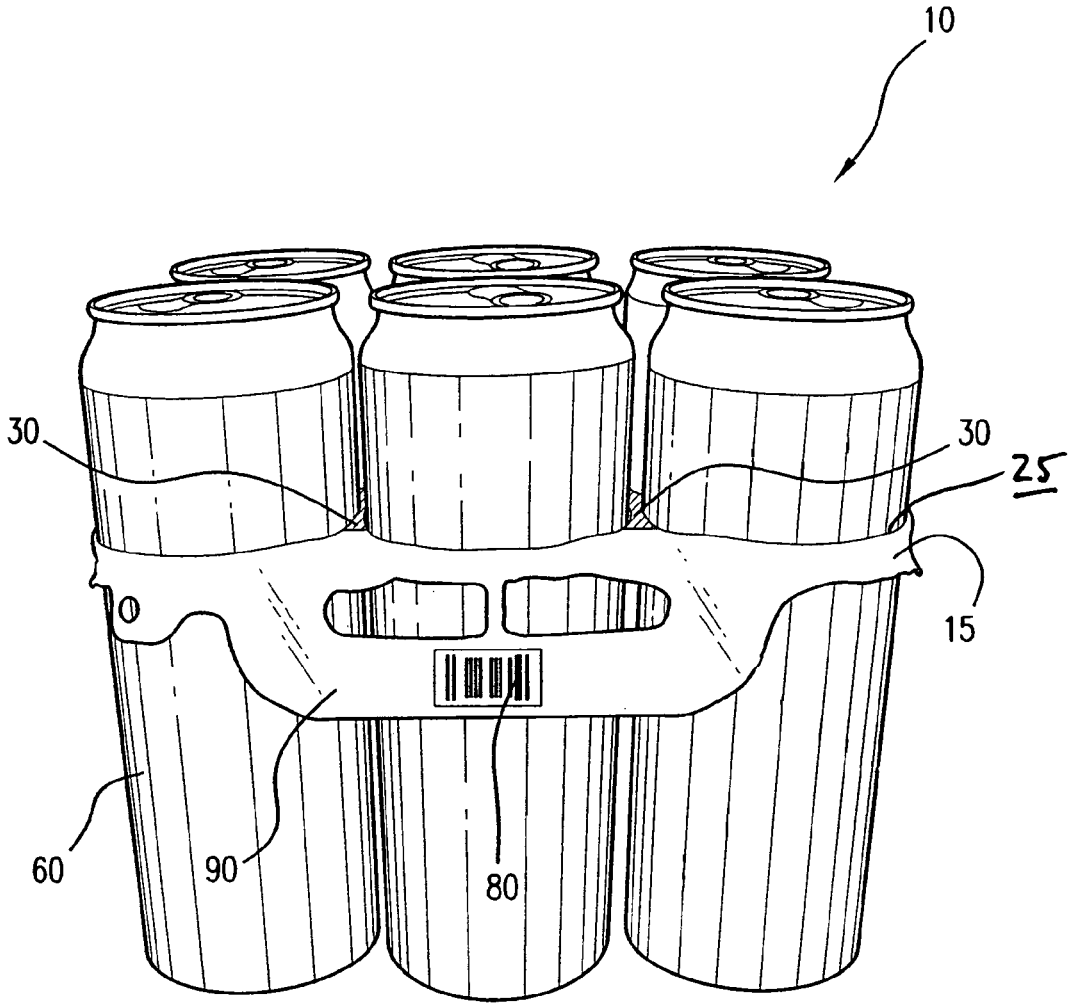
FIG. 5 is a side view of a multi-package of containers according to one preferred embodiment of this invention.

As shown in FIG. 5, carrier 15 is preferably applied around a sidewall of each respective container 60. As such, preferably directly overlaps with at least one line of each bar code 70 on each container 60, thereby preventing an effective scan by bar code reader 100, even when bar codes 70 are exposed along outer faces of containers 60.

Alternatively, such as shown in FIG. 5, carrier 15 may include a partial section or area 30 that is treated or otherwise processed to include the absorbing dye and the fluorescing dye. Area 30 preferably comprises a material and/or treatment that results in a portion of sheet 20 that absorbs or reflects light beams emitted from the bar code reader so that the bar code reader cannot read bar codes 70 on containers 60 which are covered or obscured, at least partially, by carrier 15. As used herein, "area" 30 is defined as all or part of carrier 15 including a process, treatment, ingredient, feature and/or quality that does not permit light beams from a bar code reader 100 to pass through carrier 15 and thus scan bar code 70.

As described, sheet 20 is formed of a generally transparent material and includes an array of container receiving apertures 25. Area 30 preferably extends through sheet 20 to comprise carrier 15 of the subject invention. As shown in FIG. 5, area 30 may extend within sheet 20 through a center of carrier 15, or on top of, underneath or between sheet 20. As such, area 30 may be adhered in sections or strips to sheet 20, such as with an adhesive; area 30 may be applied to sheet 20, such as with a hot stamp, an ink or paint; and/or area 30 may be manufactured into sheet 20, such as in a co-extrusion process.

According to one preferred embodiment of this invention wherein the absorbing dye and the fluorescing dye are homogeneously mixed within sheet 20, containers 60 may be placed within carrier 15 without regard to rotational orientation of bar codes 70 relative to multi-package 10.

According to another preferred embodiment of this invention, such as shown schematically in FIG. 4, the plurality of containers are rotationally oriented in the corresponding array of apertures so that each bar code 70 is positioned so that a bar code reader cannot scan each bar code 70. Although the inclusion of the absorbing dye and the fluorescing dye may alone prevent bar code reader 100 from scanning bar codes 70, such orientation may provide additional security.

Such orientation may be more preferable in an embodiment where a single area 30 of sheet 20 that includes the absorbing dye and the fluorescing dye is arranged along a center of carrier 15. As shown in FIG. 5, each bar code 70 is rotationally positioned inwardly toward area 30 and a center of a resulting package 10. However, opaque section 30 may be intermittently applied and/or positioned throughout carrier 15 based upon a desired location of bar code 70 on oriented containers 60. In any desirable configuration, each container 60 within carrier 15 may be rotationally oriented within carrier 15 so that bar code 70 is obstructed by an adjacent container 60 and/or by carrier 15.

Various desirable methods of orienting individual containers 60 are taught by Arends et al., U.S. Pat. No. 6,484,478; Arends et al., U.S. Pat. No. 6,688,465; and Arends et al., U.S. Pat. No. 6,868,652, which are each incorporated herein by reference.

According to one preferred embodiment of this invention, a second bar code 80 (or "multi-package code") may be positioned on handle 90, such as shown in FIG. 5, or other portion of package 10. The second bar code 80 may include information regarding the multi-package including new pricing and quantity information. Area 30 of sheet 20 thereby provides a dual role of blocking bar codes 70 on individual containers 60 and supporting the second bar code for multi-package labeling.

According to a preferred method of the subject invention, carrier 15 having a plurality of container receiving apertures 25 and sheet 20 having an absorbing dye and fluorescing dye area 30 is provided for engagement with a plurality of containers 60. Containers 60 are then positioned within carrier 15 and additionally may be oriented so that bar code 70 of each container 60 is blocked by adjacent containers 60 and/or area 30 of carrier 15. As described in the Arends et al. patents, incorporated herein be reference, each container 60 may be oriented before it is positioned within carrier 15; after container 60 is positioned within carrier 15 or some combination of orienting containers 60 before and after engagement with carrier 15.

According to one desired embodiment of this invention, each container 60 is oriented, prior to engagement with carrier 15, so that each bar code 70 faces a corresponding bar code 70 in a transversely adjacent container 60. Carrier 15 is then applied to a desired set of containers 60 resulting in a unitized package 10.

While in the foregoing specification this invention has been described in relation to certain preferred embodiments thereof, and many details have been set forth for purpose of illustration, it will be apparent to those skilled in the art that package is susceptible to additional embodiments and that certain of the details described herein can be varied considerably without departing from the basic principles of the invention.

The invention claimed is:

1. A multi-package for carrying an array of containers in a corresponding array of apertures, the multi-package comprising:

a sheet formed of a generally transparent material having the array of apertures, the sheet containing an absorbing dye and a fluorescing dye within at least a portion of the sheet;

the array of containers positioned in respective apertures of the array of apertures, each container of the array of containers including a bar code; and the sheet blocks the bar code on the each container so that the bar code is not readable by a bar code scanner.

2. The multi-package of claim 1, wherein the containers are oriented within the apertures of the plastic sheet.

3. The multi-package of claim 1, wherein the at least a portion of the sheet extends in a strip through a center portion of the sheet and generally between rows of apertures.

4. The multi-package of claim 3, wherein the containers are oriented so that each bar code of each container is generally facing a central location of the multi-package.

5. The multi-package of claim 1, wherein the absorbing dye and the fluorescing dye are dispersed homogeneously within the entire sheet.

6. The multi-package of claim 1, wherein the absorbing dye and the fluorescing dye are mixed with a plastic resin to form the sheet.

7. The multi-package of claim 1 wherein the absorbing dye comprises a red absorbing dye.

8. The multi-package of claim 1 wherein the fluorescing dye comprises a UV fluorescing dye.

9. A carrier for carrying an array of containers in a corresponding array of apertures, each container of the array of containers including a bar code, the carrier comprising:

a sheet formed of a generally transparent plastic resin, the sheet containing an absorbing dye and a fluorescing dye, the sheet including the array of apertures for engaging the array of containers, and the sheet blocks the bar codes so that the bar codes are not readable by a bar code reader.

10. The carrier of claim 9 wherein the absorbing dye comprises a red absorbing dye.

11. The carrier of claim 9 further comprising a third dye for adjusting a color balance of the sheet.

12. The carrier of claim 9 wherein the absorbing dye and the fluorescing dye are concentrated along a center portion of the sheet.

13. The carrier of claim 9 wherein the absorbing dye is in the range of approximately 660 nm to approximately 680 nm.

14. The carrier of claim 9 wherein the fluorescing dye is in the range of approximately 600 nm to approximately 640 nm.

* * * * *